US006070772A

United States Patent [19]

Bond

[11] Patent Number: 6,070,772

[45] Date of Patent: Jun. 6, 2000

[54] NON-SLIP GARMENT HANGER WITH A COORDINATE LOOP

[75] Inventor: Steve Bond, Stony Brook, N.Y.

[73] Assignee: Red Wing Products, Plainview, N.Y.

[21] Appl. No.: 09/075,812

[22] Filed: May 11, 1998

[51] Int. Cl.[7] ..... A47G 25/14

[52] U.S. Cl. ..... 223/85; 223/88

[58] Field of Search ..... 223/85, 92, 88, 223/98, 95, DIG. 4; D6/315

[56] References Cited

U.S. PATENT DOCUMENTS

| | | | |
|---|---|---|---|
| D. 394,753 | 6/1998 | Zuckerman | D6/328 |
| 4,373,113 | 2/1983 | Winkler et al. | 174/179 |
| 4,385,025 | 5/1983 | Salerno et al. | 264/255 |
| 4,653,678 | 3/1987 | Blanchard et al. | 223/85 |
| 4,840,760 | 6/1989 | Oishi | 264/245 |
| 4,871,098 | 10/1989 | Bredeweg et al. | 223/85 |
| 5,020,705 | 6/1991 | Garrison | 223/96 |
| 5,022,571 | 6/1991 | Blanchard et al. | 223/95 |
| 5,078,307 | 1/1992 | Suddath | 223/92 |
| 5,170,916 | 12/1992 | Kolton et al. | 223/92 |
| 5,277,345 | 1/1994 | Ozaki | 223/98 |
| 5,516,014 | 5/1996 | Garrison | 223/96 |
| 5,535,927 | 7/1996 | Garrison | 223/92 |
| 5,803,321 | 9/1998 | Willinger et al. | 223/88 |
| 5,839,629 | 11/1998 | Zuckerman | 223/85 |

*Primary Examiner*—Bibhu Mohanty
*Attorney, Agent, or Firm*—Carella Byrne Bain Gilfillan Cecchi Stewart & Olstein

[57] ABSTRACT

The plastic garment hanger is made of styrene butadiene and is provided with an integrally bonded smooth and uninterrupted non-slip surface of a thermoplastic elastomer on each arm. A coordinate loop is also provided in a form to prevent twisting and turning of a supported hanger. The plastic hanger is made of a material which permits the hanger to be resiliently deformed.

14 Claims, 2 Drawing Sheets

10
12
13
14
15
16
17
18
19
20
21
22
23
24
27
28
6

NON-SLIP GARMENT HANGER WITH A COORDINATE LOOP

This invention relates to a non-slip hanger. More particularly, this invention relates to a non-slip garment hanger with a coordinate loop.

One of the problems associated with garment hangers is that garments can slip off the hangers and fall to a floor. This is a particular problem in retail outlets since customers cannot be relied upon to pick garments off a floor and to put them back onto a hanger. As a result, the garments may be left to lay on a floor thereby becoming wrinkled and/or soiled. Accordingly, various shapes and constructions have been used for hangers in order to provide gripping surfaces to prevent a garment from slipping off the hanger during use.

In the case of plastic hangers, other problems arise in providing such hanger with non-slip surfaces. For example, where hangers have been provided with felt or foam-like strips, the strips have been glued or otherwise adhered to the plastic hangers after the hangers have been molded into the final form. However, strips can be readily forn from the hangers when in use, particularly if a user handles the hangers in a clumsy manner.

U.S. Pat. No. 4,586,637 describes a plastic garment hanger which is provided with a flexible, sleeve-type member having an upper surface of uneven contour formed by a plurality of short bristle-like projections. This surface is said to provide large friction forces between the upper surface and any item which bears against it. However, as can be appreciated, in the case of fragile garments, the short bristle-like projections may well deform or pierce through the garment. Further, depending upon the degree of care which a customer in a retail store might use, the short bristle-like projections of the hanger might well catch on any garment which is being removed from the hanger by the customer.

Other techniques to hold garments on plastic hangers have also been known, for example, from U.S. Pat. No. 5,535,927. In these cases, use is made of a series of cleats on the support surfaces of a plastic hanger with each cleat including an upwardly protruding nipple-like projection. In addition, gripping sections of resilient material are disposed over discrete sections of the cleats so that the hanger has coated cleats and uncoated cleats. However, the contour provided by the various cleats is of a non-continuous surface so that fragile garments can become deformed or puckered. Further, the construction of such a hanger is rather time consuming and cumbersome.

Hangers have also been known to have built-in coordinate loops in order to receive and support a second hanger, for example so that a pair of garments can be displayed in a coordinated manner. In some cases, the coordinate loop is formed simply as a loop which depends from the hanger. However, such a loop allows a supported hanger to twist and turn so that re-hanging of a garment on the supported hanger becomes difficult. In other cases, many of the loops have been of relatively complicated construction, such as described in U.S. Pat. Nos. 4,871,098 and 4,653,678. Further, several of the known loops require extensive manipulation of the second hanger onto the loop. Also, in some cases where the loop has been formed for entry from one side, a rather large opening in the front of the loop allows a hanger to pass through so that care must be taken to ensure that the second hanger does not pass through the front of the loop and thereby becoming skewed out of proper position.

As is known, plastic hangers can be subjected to abuse during handling so that even though the hangers are basically resiliently deformable this has only been to a point. Should a plastic hanger be twisted beyond a certain limit, the hanger can be broken or damaged to such an extent that the hanger is no longer useable. Accordingly, there is a need to provide a plastic hanger which can be subjected to sever abuse from flexing and/or twisting without becoming distorted, deformed or broken.

Accordingly, it is an object of the invention to provide a plastic hanger with a non-slip surface which can be efficiently incorporated in the hanger.

It is another object of the invention to provide a molded plastic hanger with a relatively simple coordinate loop.

It is another object of the invention to be able to incorporate a non-slip surface in a molded plastic hanger in a simple efficient manner.

It is another object of the invention to provide a plastic hanger which can be resiliently deformed and twisted without being damaged.

It is an object of the invention to provide a coordinate loop of relatively simple construction which does not require threading and twisting of a hook of a second hanger therethrough.

Briefly, the invention provides a hanger of relatively simple construction which provides several desirable characteristics. First, the hanger is constructed to provide non-slip surfaces for receiving garments thereon. Second, the garment hanger is constructed with a relatively simple coordinate loop to receive a second hanger in a simple manner while securely supporting the second hanger. Third, the garment hanger is constructed of materials which permit the hanger to be resiliently deformed and twisted without losing its integrity.

Generally, the garment hanger includes an elongated plastic body having a central section and a pair of arms which extend from opposite sides of the central section. In addition, a resilient friction coating is disposed on an upper surface of each arm for frictionally retaining a garment on the arm.

In accordance with the invention, the resilient friction coating is made of a thermoplastic elastomer and is integrally bonded to each arm. In this respect, the friction coating is formed on the hanger using a post-injection technique after manufacture of the hanger. Any suitable post-injection technique may be used to integrally bond the friction coating onto the main body of the hanger.

The resilient friction coating which is provided on each arm is characterized in having an uninterrupted continuous upper surface for frictionally engaging with a garment. Thus, there are no projections which can deform a garment or catch in a garment.

The garment hanger also has a coordinate loop depending from the central section of the body which is integrally molded with the body and which is constructed to hold a hook of a depending hanger in a generally fixed position centrally of and co-planar with the supporting hanger. To this end, the coordinate loop includes a first block with a pair of upstanding legs and an L-shaped block which is perpendicular to and integral with the first block in order to define an opening with the first block. The opening between the two blocks is such that the hook of a second hanger can be readily threaded into the opening from either side so that the hook is coplanar with the central portion of the garment hanger. In addition, the L-shaped block and the first block cooperate to provide three abutting surfaces to prevent the hook of the dependent hanger from rotating or twisting. That is to say, the L-shaped block provides an abutment surface opposite and between two abutment surfaces defined by the first block of the loop. These three surfaces serve to maintain the hook in a generally fixed position parallel to the central section of the garment hanger.

The garment hanger may be provided with an upstanding apertured post on the central section for receiving a hook for hanging of the hanger from a support. Alternatively, a hook may be formed integrally with the central portion.

The elongated body of the hanger is made of a material which allows each arm to be resiliently deformable in a direction perpendicular to the plane of the body and resiliently twistable about a longitudinal axis of the respective over an angle of more than 90°. In one particular embodiment, each arm is resiliently twistable over an angle of over 180° relative to the longitudinal axis. In this respect, the hanger body is made of an SBS material (styrene butadiene) known as K resin supplied by Philips Chemicals, Houston, Tex.

The ability of the garment hanger to be resiliently deformed and twisted without losing its integrity allows the hanger to be subjected to substantial abuse without being permanently deformed or broken. Thus, during transportation of a large number of garments and hangers from place-to-place, the risk of a hanger becoming deformed and/or broken is substantially reduced. Likewise, the risk of a garment falling off a broken hanger and becoming wrinkled, soiled or otherwise damaged is substantially reduced.

These and other objects and advantages of the invention will become more apparent from the following detailed description taken in conjunction with the accompanying drawings wherein.

Figures 1, 4, 5, 6:
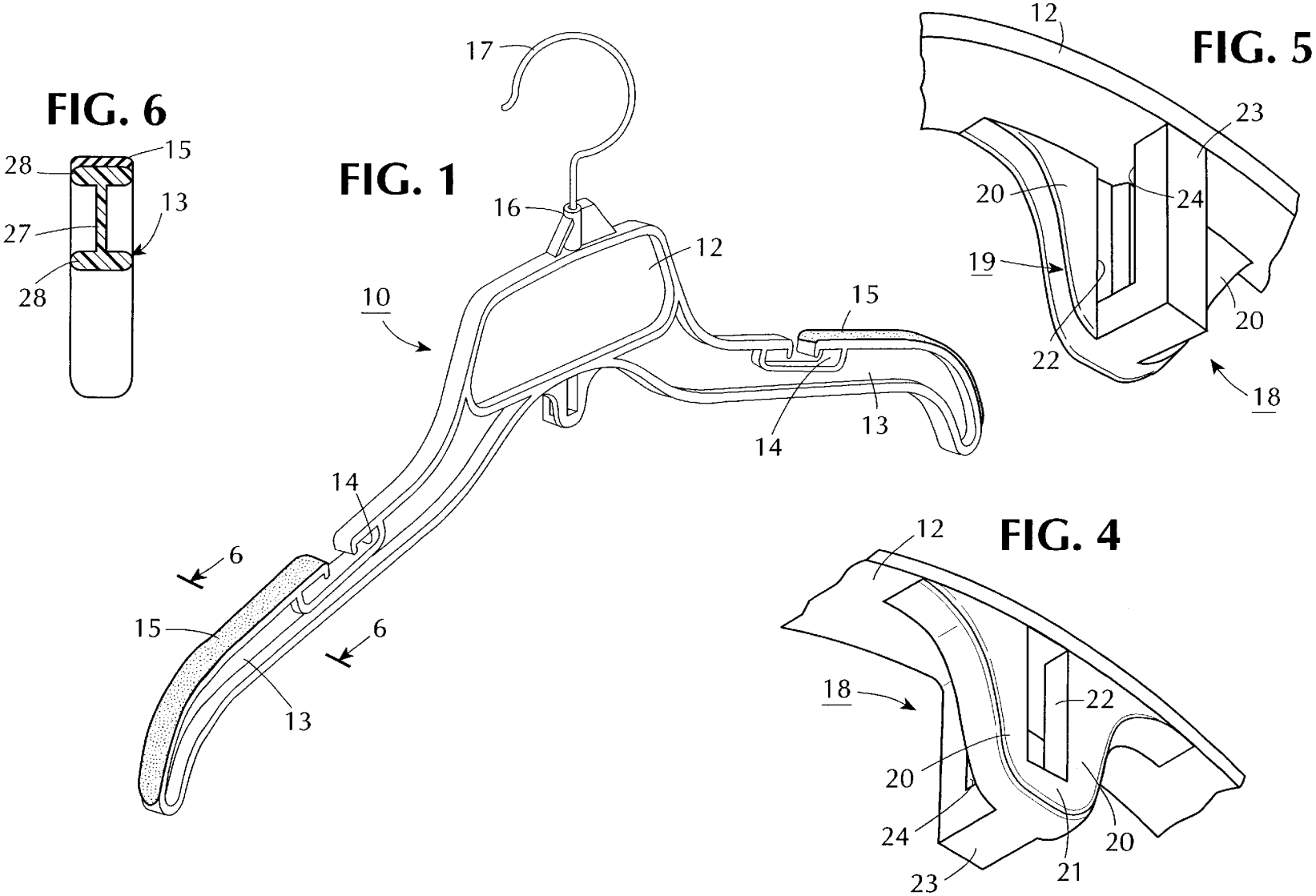
FIG. 1 illustrates a perspective view of a garment hanger constructed in accordance with the invention.
FIG. 4 illustrates a perspective view from one side of the coordinate loop of the hanger of FIG. 1.
FIG. 5 illustrates a rear view of the coordinate loop of FIG. 4.
FIG. 6 illustrates a cross sectional view taken on line 6—6 of FIG. 1 of the hanger with a resilient friction coating thereon in accordance with the invention.

Referring to FIG. 1, the garment hanger 10 is of a generally conventional structure made of K resin, e.g. a styrene butadiene, supplied by Philps Chemicals of Houston, Tex. and having an elongated molded plastic body 11 with a central section 12 and a pair of arms 13 extending from opposite sides of the central section 12.

The garment hanger 10 is shown with a recess 14 of conventional construction in each arm 13. These recesses 14 do not form a part of the invention and are simply shown to indicate one possible use of the garment hanger.

Referring to FIGS. 1 and 6, each arm 13 is provided with a resilient friction coating 15 on an upper surface for frictionally retaining a garment on each of the arms 13. The resilient coating is made of a thermoplastic elastomer supplied by QST of St. Albans, Vt. under the designation grade: Monoprene MP-1644 and is integrally bonded to the arm 13. As indicated in FIG. 1, each friction coating 15 presents a flat uninterrupted continuous upper surface for frictionally engaging with a garment. That is to say, there are no protuberances or interruptions which might otherwise catch in a garment or permit a garment to catch thereon.

By way of example, the resilient friction coating 15 has a thickness of from 0.040 inches to 0.060 inches and a width of from 0.380 inches to 0.420 inches. As indicated in FIG. 6, the resilient coating 15 is of the same width as the arm 13.

Each resilient coating 15 is integrally bonded to the garment hanger after the garment hanger has been molded. For example, after the hanger IO has been molded in a suitable mold and cooled, a plurality of hangers are stacked together, for example in groups of six hangers and disposed within a second mold. Thereafter, the thermoplastic elastomer material is injected into this second mold to bond to the two arms of each hanger to form the resilient friction coatings 15 on the arms of the each hanger. This is followed by a cooling step and then an ejection step.

During the molding operation, the thermoplastic elastomer becomes integrally bonded to the SBS material of the hanger, such that it becomes very difficult to peel off the resilient coating from the hanger 10. At the same time, each coating 15 is formed with a smooth uninterrupted surface to avoid projections on which a garment might otherwise catch.

Typically, the elastomer is bonded to the hanger 10 under a processing temperature of 190° F. In this respect, the mold is maintained heated by use of manifolds which extend through the mold to convey a heating medium. The time required for a complete cycle of loading-injection-cooling-ejection is approximately 10 seconds with the actual injection step for the elastomer being 1.5 seconds.

Referring to FIG. 1, the garment hanger 10 has an upstanding apertured post 16 on the central section 12 for receiving a hook, for example, a metal hook 17, for hanging of the body 11 from a support (not shown). In the alternative, the hanger 10 may be molded with an integral hook (not shown).

Referring to FIG. 1, the garment hanger also includes a coordinate loop 18 which depends from and is integrally molded with the central section 12 of the hanger body 11.

Referring to FIGS. 4 and 5, the coordinate loop 18 includes a first block 19 which is formed with a pair of upstanding curvilinear legs 20, each of which merges into the central section 12 of the hanger body 11 as well as an integral web 21 which is molded between the legs 20 at the lower ends in order to define a rectangular shaped opening 22 with the legs 20. The coordinate loop 18 also has a second solid L-shaped block 23 which is perpendicular to and integral with the first block 19 in order to define an opening 24 which communicates with the rectangular opening 22 and the first block 19. Typically, the coordinate loop 18 is molded to be integral with the remainder of the hanger 10.

During molding of the hanger 10, suitable inserts are used for the formation of the coordinate loop 18. For example, one insert is positioned to permit formation of the apertured first block 19 and the L-shaped block 23. This insert is also retractable through the rectangular opening 22 which is formed between the legs 20 of the first block 19 in order to permit the hanger 10 to be removed from the mold.

Figure 2:
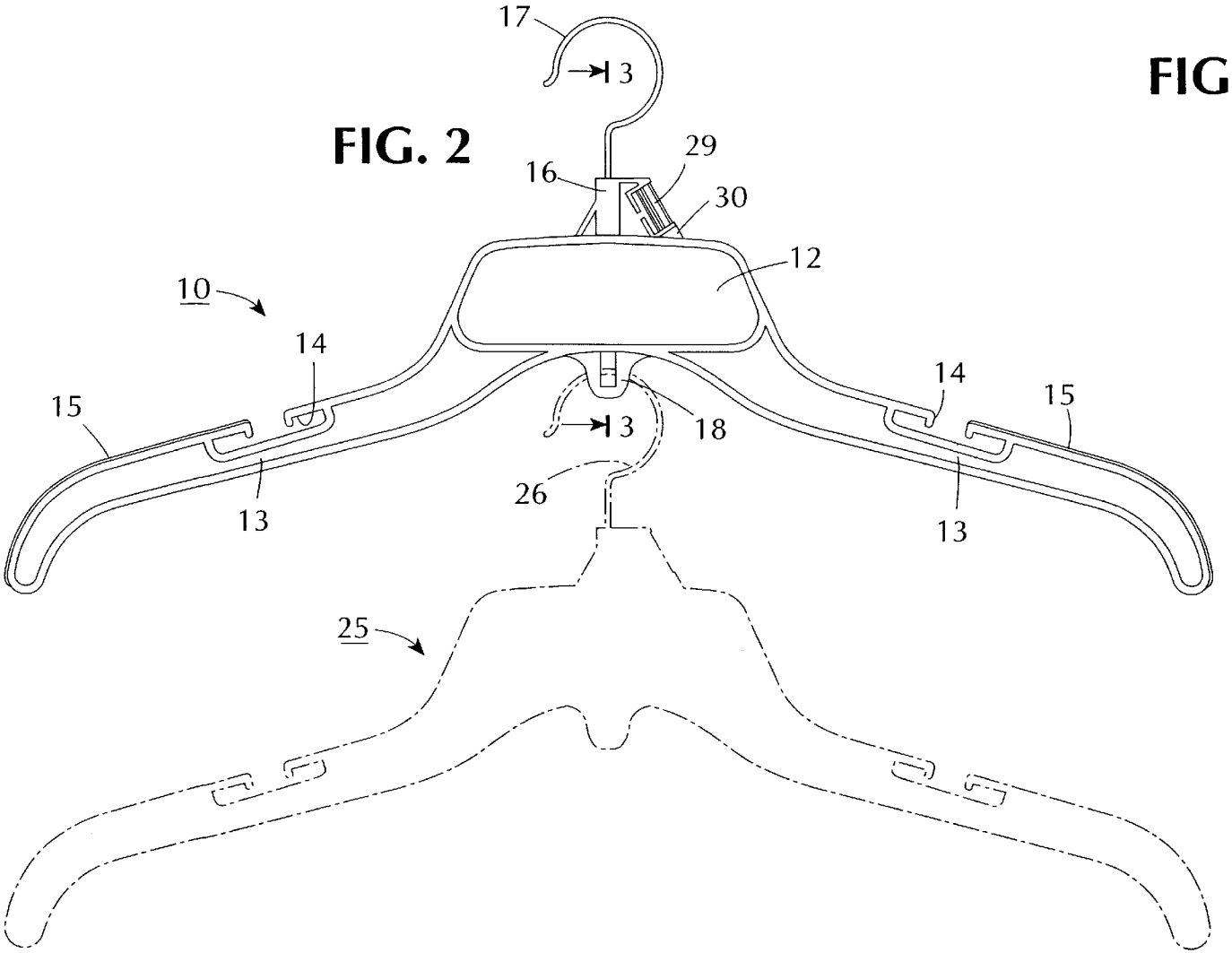
FIG. 2 illustrates a front view of the garment hanger of FIG. 1 with a dependent hanger shown in phantom depending from the coordinate loop.

Referring to FIG. 2, the coordinate loop 18 is used to receive and depend a second hanger 25 therefrom. As indicated in phantom lines, the hanger 25 may be of any suitable construction and is provided with an upstanding hook 26 which is sized to be received within the opening of the loop 18.

Figure 3:
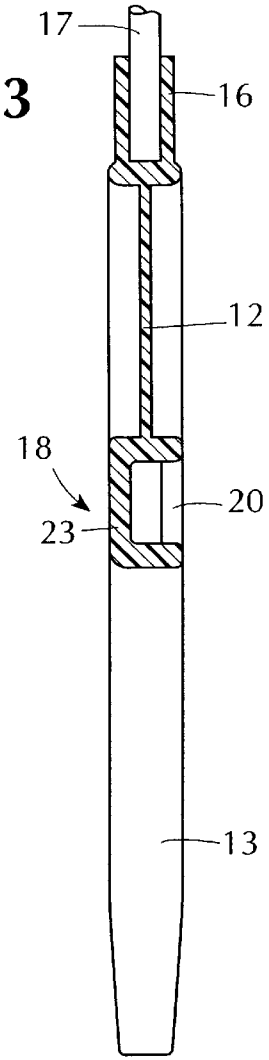
FIG. 3 illustrates a cross sectional view taken on line 3—3 of FIG. 2.

As indicated in FIG. 3, the apertured block 19 of the coordinate loop 18 is located to one side of the central section 12 of the hanger 10 while the second L-shaped block 23 is disposed to the opposite side in alignment with the opening 22 in the apertured block 19 and of equal size to the opening 22. Thus, the opening 24 provided by the L-shaped block 23 is located in the central vertical plane of the hanger 10 and symmetrically below the plane of the central section 12 and the hook 17. Further, the opening 24 is of a size so as to allow passage of the hook 26 of the dependent hanger 25 therethrough as indicated in FIG. 2.

Referring to FIG. 2, when the dependent hanger 25 is received in the coordinate loop 18, the weight of the dependent hanger 25 is aligned with the central section 12 and hook 17 of the main hanger 10. Thus, garments hanging from the two hangers 10, 25 should drape evenly.

Referring to FIG. 5, the blocks 19, 23 of the coordinate loop 18 provide three surfaces for abutment of the hook 26 of a dependent hanger 25 (see FIG. 2). That is to say, the L-shaped block 23 provides one abutment surface to one side of the hook 26 while the legs 20 of the first block 19 provide two abutment surfaces on the opposite side of the hook 26 of the dependent hanger 25. Thus, as indicated in FIG. 2, the hook 26 of the dependent hanger 25 is retained against twisting or rotation by a three point contact with the coordinate loop 18.

The coordinate loop 18 thus allows a dependent hanger to be simply threaded into the coordinate loop 18 and to be held against twisting or rotation in a simple manner. Since the front opening 22 is of limited width being equal in width to the L-shaped block 23, there is little risk that the hook of a dependent hanger could be inadvertently threaded through the side opening of the loop 18 and through the front opening 22. Thus, the hook of the dependent hanger can be quickly and reliably positioned in parallel manner to the hook 17 of the main hanger 10.

The garment hanger 10 is made of a material, such as a K resin, i.e. a SBS material, which allows each arm 13 of the body 11 to be resiliently deformable in a direction perpendicular to the plane of the body 11 and resiliently twistable about a longitudinal axis of the respective arm 13 over an angle of more than 90°. For example, each arm 13 may be twisted about its longitudinal axis over an angle of 180° relative to the longitudinal axis. That is to say, the free end of each arm 13 may be twisted into an upstanding position 180° from that as shown in FIG. 1 without permanent deformation or breaking of the arm 13.

In one respect, the arms 13 of the garment hanger 10 may be characterized as being made of rubber-like material which can be resiliently twisted but yet which returns to the original molded shape.

As illustrated in FIG. 6, each arm 13 is made of I-beam like construction having a central web 27 and a pair of flanges 28 so as to impart vertical stability and rigidity against loading in a vertical direction.

Referring to FIG. 2, the permanent hanger 10 may also be provided with a size marker 29 which is mounted over a suitable mounting means 30 provided adjacent to the upstanding post 16 of the hanger 10. For example, the marker 29 and mounting means 30 may be as described in U.S. Pat. No. 5,687,887.

The invention thus provides a garment hanger as characterized in having non-slip surfaces on the arms to prevent garments from sliding off the arms.

Further, the invention provides a garment hanger which is characterized in having a relatively simple coordinate loop for receiving a second hanger in dependent fashion in a relatively simple stable manner.

Still further, the invention provides a garment hanger which is characterized in having hooks which can be resiliently deformed and twisted without breaking so as to provide a rugged long-lasting hanger which can be subjected to abuse during transportation.

What is claimed is:

1. A hanger comprising an elongated plastic body having a central section and a pair of arms extending from opposite sides of said central section; and a resilient friction coating integrally bonded on an upper surface of each of said arms; each said resilient friction coating having a flat uninterrupted continuous upper surface for frictionally engaging with a garment thereon.

2. A hanger as set forth in claim 1 wherein said resilient friction coating is made of a thermoplastic elastomer.

3. A hanger as set forth in claim 1 wherein said resilient friction coating has a thickness of from 0.040 to 0.060 inches.

4. A hanger as set forth in claim 1 which further comprises a coordinate loop depending from said central section of said body.

5. A hanger as set forth in claim 4 wherein said coordinate loop is integrally molded with said body.

6. A hanger as set forth in claim 5 wherein said loop has a first block with a pair of upstanding legs merging into said body at an upper end.

7. A hanger as set forth in claim 6 wherein said loop includes an L-shaped block perpendicular to and integral with said first block to define an opening with said first block.

8. A hanger as set forth in claim 1 which further comprises an upstanding apertured post on said central portion for receiving a hook for hanging of said body from a support.

9. A hanger as set forth in claim 1 wherein each said arm of said body is resiliently deformable in a direction perpendicular to the plane of said body and is resiliently twistable about a longitudinal axis of said respective arm over an angle of more than 90°.

10. A hanger as set forth in claim 9 wherein said body is made of styrene butadiene and each said coating is made of a thermoplastic elastomer.

11. A hanger as set forth in claim 7 wherein said L-shaped block is solid.

12. A hanger comprising an elongated plastic body having a central section and a pair of arms extending from opposite sides of said central section;

a resilient friction coating integrally bonded on an upper surface of each of said arms, each said resilient friction coating having an uninterrupted continuous upper surface frictionally engaging with a garment thereon; and a coordinate loop depending from said central section of said body and integrally molded with said body, said loop including a first block having a pair of upstanding legs having an opening therebetween and a second L-shaped block perpendicular to and integral with said first block to define an opening with said first block to receive a hanger hook therebetween, said second block being disposed in alignment with said opening in said first block and being of equal size thereto.

13. A hanger comprising an elongated plastic body having a central section and a pair of arms extending from both opposite sides of said central section; and a resilient friction coating integrally bonded on an upper surface of each of said arms and being of equal width to a respective arm; each said resilient friction coating having a flat uninterrupted continuous upper surface for frictionally engaging with a garment thereon.

14. A hanger comprising an elongated molded one-piece plastic body having a central section and a pair of arms extending from both opposite sides of said central section; and a resilient friction coating post-injection molded and integrally bonded on an upper surface of each of said arms; each said resilient friction coating having an uninterrupted continuous upper surface for frictionally engaging with a garment thereon.

* * * * *